US009952019B2

(12) United States Patent
Burkland

(10) Patent No.: US 9,952,019 B2
(45) Date of Patent: Apr. 24, 2018

(54) ULTRASONIC ELECTRO-OPTIC SEEKER

(71) Applicant: Raytheon Company, Waltham, MA (US)

(72) Inventor: Michael K. Burkland, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 226 days.

(21) Appl. No.: 15/059,720

(22) Filed: Mar. 3, 2016

(65) Prior Publication Data

US 2017/0254623 A1 Sep. 7, 2017

(51) Int. Cl.

| | |
|---|---|
| ***F41G 7/22*** | (2006.01) |
| ***F42B 30/00*** | (2006.01) |
| *F41G 7/00* | (2006.01) |

(52) U.S. Cl.

CPC ..... *F41G 7/2213* (2013.01); *F42B 30/006* (2013.01)

(58) Field of Classification Search

CPC .... F41G 7/2213; F41G 7/2293; F42B 30/006; F42B 15/10; H01Q 3/2664; G01C 19/48

See application file for complete search history.

(56) References Cited

U.S. PATENT DOCUMENTS

| | | | | |
|---|---|---|---|---|
| 6,326,759 | B1 | 12/2001 | Koerner et al. | |
| 6,396,233 | B1 | 5/2002 | Christison et al. | |
| 7,894,144 | B2 | 2/2011 | Wein et al. | |
| 8,537,377 | B2 | 9/2013 | Burkland | |
| 8,841,868 | B2 | 9/2014 | Toyama et al. | |
| 2003/0098387 | A1* | 5/2003 | Baumann et al. | F41G 7/2213 |
| 2008/0217465 | A1* | 9/2008 | Facciano et al. | F42B 15/10 |
| 2015/0303566 | A1* | 10/2015 | Nowack | H01Q 3/2664 |
| 2015/0316376 | A1* | 11/2015 | Williams | G01C 19/48 |
| 2015/0316761 | A1* | 11/2015 | Williams | F41G 7/2293 |

OTHER PUBLICATIONS

Bar-Cohen et al., "Rotary Ultrasonic Motors Actuated by Traveling Flexural Waves", Proceedings of SPIE's 6th Annual International Symposium on Smart Structures and Materials, Mar. 1-5, 1999, pp. 1-7.

Mashimo et al., "Design and Implementation of Spherical Ultrasonic Motor", IEEE Transactions on Ultrasonics, Ferroelectrics, and Frequency Control, vol. 56, No. 11, Nov. 2009, pp. 2514-2521.

* cited by examiner

*Primary Examiner* — Bernarr E Gregory

(74) *Attorney, Agent, or Firm* — Cantor Colburn LLP

(57) ABSTRACT

A ball joint gimbal (BJG) seeker assembly is provided and includes a back shell, a retaining system disposed to urge the seeker ball toward the back shell and a piezoelectric ultrasonic motor and sensor system arrayed between the seeker ball and the back shell. The piezoelectric ultrasonic motor and sensor system is pre-loaded by the retaining system and configured to controllably drive an angular orientation of the seeker ball.

20 Claims, 7 Drawing Sheets

ULTRASONIC ELECTRO-OPTIC SEEKER

BACKGROUND

The present invention relates to electro-optic (EO) seekers and, more specifically, to EO seekers with ultrasonic piezoelectric motors for driving a sensor ball.

Missile guidance refers to a variety of methods of guiding a missile or a guided bomb to its intended target. The missile's target accuracy is a critical factor for its effectiveness and guidance systems improve missile accuracy by improving its "Single Shot Kill Probability" (SSKP). Guidance technologies can generally be divided into a number of categories, with the broadest categories being "active," "passive" and "preset" guidance. Active guidance refers to cases in which guidance signals are generated in real time on board a missile. Passive guidance refers to cases in which guidance signal home in on a signal generated by the target. Preset guidance refers to cases in which guidance signals are preset and loaded into a missile prior to launch.

For active and passive guidance, traditional missile seekers typically include a sensor and often require a gimbaled system be coupled to that sensor. The gimbaled system enables a field-of-view (FOV) of the sensor to permit the senor to scan over time a full field-of-regard (FOR). The size, weight and power and cost (SW&P/C) for such gimbaled system hardware is always a considerable challenge, however, when faced with high performance and low cost requirements normally associated with missile design.

Thus, gimbaled system hardware for missile seekers has been developed with an eye toward size and weight reductions for small diameter airframes. This has led to a ball joint gimbal (BJG) design in which a dual sensor is housed on a sensor ball and is controlled by Kevlar™ tendons that are motor driven from within a seekerhead housing. These motors tend to consume a considerable amount of space within the seeker-head housing, however, and are relatively expensive.

SUMMARY

According to one embodiment of the present invention, a ball joint gimbal (BJG) seeker assembly is provided and includes a back shell, a retaining system disposed to urge the seeker ball toward the back shell and a piezoelectric ultrasonic motor and sensor system arrayed between the seeker ball and the back shell. The piezoelectric ultrasonic motor and sensor system is pre-loaded by the retaining system and configured to controllably drive an angular orientation of the seeker ball.

According to another embodiment, a missile is provided and includes a nose cone having an open forward end, a seeker dome disposable at the open forward end of the nose cone and a ball joint gimbal (BJG) seeker assembly securely disposable in the open forward end of the nose cone. The BJG seeker assembly includes a back shell configured to be coupled to a rim of the nose cone, a seeker ball in which seeker components are housed, a retaining system disposed to urge the seeker ball toward the back shell and a piezoelectric ultrasonic motor and sensor system arrayed between the seeker ball and the back shell. The piezoelectric ultrasonic motor and sensor system is pre-loaded by the retaining system and configured to controllably drive an angular orientation of the seeker ball.

According to another embodiment, a ball joint gimbal (BJG) seeker assembly is provided for use in a missile including a nose cone having an open forward end and a seeker dome disposable at the open forward end of the nose cone. The BJG seeker assembly includes a back shell configured to be coupled to a rim of the nose cone, a seeker ball in which seeker components are housed, a retaining system disposed to urge the seeker ball toward the back shell and a piezoelectric ultrasonic motor and sensor system arrayed between the seeker ball and the back shell. The piezoelectric ultrasonic motor and sensor system is pre-loaded by the retaining system and configured to drive an angular orientation of the seeker ball relative to the back shell based on a closed-loop control algorithm.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
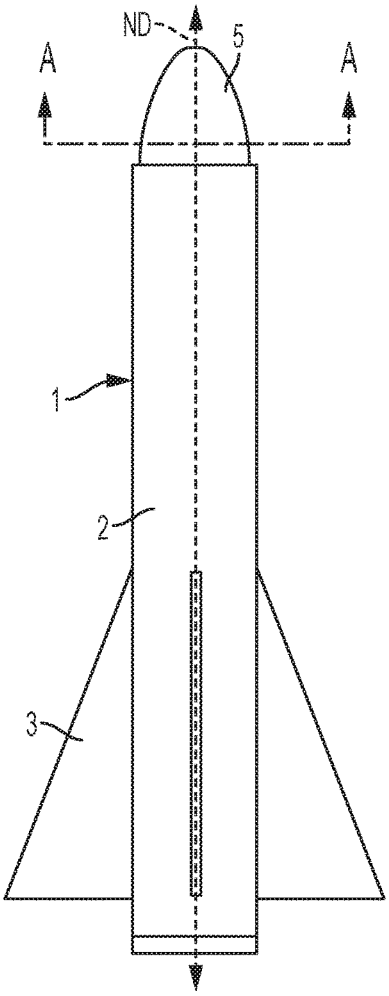
FIG. 1 is a side view of a missile in accordance with embodiments.
Figure 2:
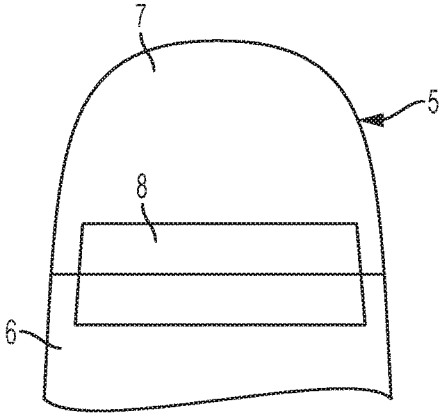
FIG. 2 is an enlarged view of a cross-section of a nose cone section of the missile of FIG. 1 taken along lines A-A.

As will be described below, piezoelectric ultrasonic rotary or linear motors are provided for use in driving angular orientations of a ball joint gimbal (BJG) seeker. Three or more rotary or linear motors are placed within a ball joint and stators for each of the rotary or linear motors are disposed in contact with a sensor ball. The rotary or linear motors may be pre-loaded against a back shell, each facing one of the three orthogonal axes of rotation and distributed one hundred and twenty degrees apart in azimuth with respect to one another and pitched forty five degrees in elevation along the interior of the ball socket for uncoupled control of motion. Three angular degrees of motion are then controlled by the combined torque applied by all of the rotary or linear motors in a sequence suitable to the desired rotation of the sensor ball. A coupled design with a motor placement distribution different from the 120°-azimuth, and 45°-elevation configuration and/or more than three motors is feasible.

Additionally, the ultrasonic motor technology can provide for high precision stability in the line-of-sight (LOS stability) of the seeker with suitable closed-loop feedback information of angular deviation of the seeker in inertial space.

With reference to FIGS. 1-4, a missile 1, a gravity munition or a motorless bomb is provided and includes an elongate fuselage 2, fins 3 with controllable aerodynamic surfaces and a nose cone section 5. The nose cone section 5 is situated at the forward end of the fuselage 2 and includes a nose cone 6, a seeker dome 7 and a ball joint gimbal (BJG) seeker assembly 8. The nose cone 6 has a frusto-conical shape that tapers inwardly with increasing distance in the forward direction and a rim 9 defining an open forward end 10. The seeker dome 7 is disposable at the open forward end 10 and may be coupled to the rim 9. The seeker dome 7 is formed of material that is transparent to certain electromagnetic (EM) radiation (e.g., Infrared (IR) radiation in a heat seeking case). The BJG seeker assembly 8 is disposable in the open forward end 10 and is configured to emit or receive EM radiation via the material of the seeker dome 7 in order to provide for navigational control and targeting of the missile 1.

With reference to FIGS. 3-11, the BJG seeker assembly 8 includes a back shell 20 and a seeker ball 30 as well as a retaining system 40, a piezoelectric ultrasonic motor system (with either rotary or linear motor drives) and a control loop feedback angular sensor system 50 (hereinafter referred to as a "sensor system 50").

Figure 3:
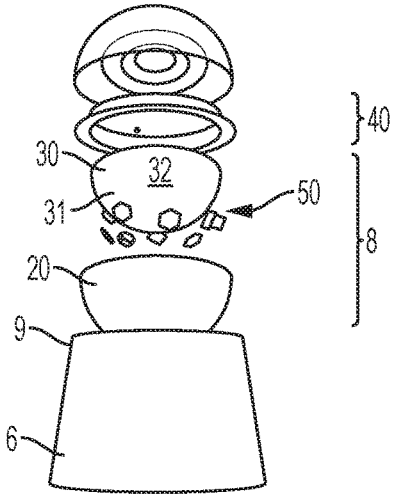
FIG. 3 is an exploded perspective view of the nose cone section of the missile and a ball joint gimbal (BJG) seeker assembly in accordance with embodiments.
Figure 4:
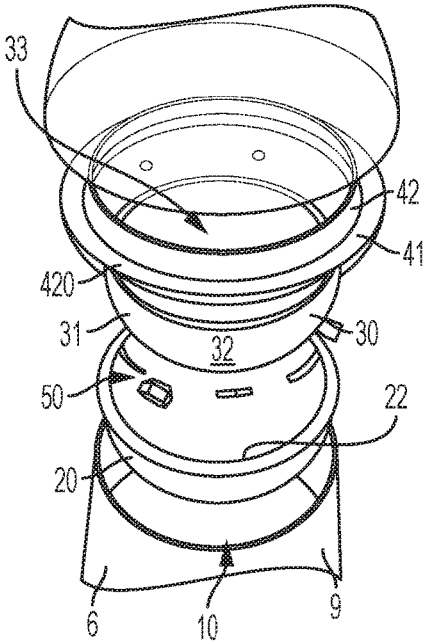
FIG. 4 is an exploded perspective view of the nose cone section of the missile and a ball joint gimbal (BJG) seeker assembly in accordance with embodiments.
Figure 5:
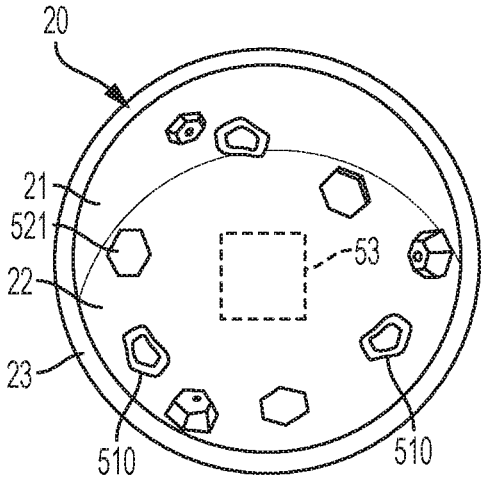
FIG. 5 is a top-down view of a back shell and portions of a retaining system and a piezoelectric ultrasonic rotary motor and sensor system in accordance with alternative embodiments.
Figure 6:
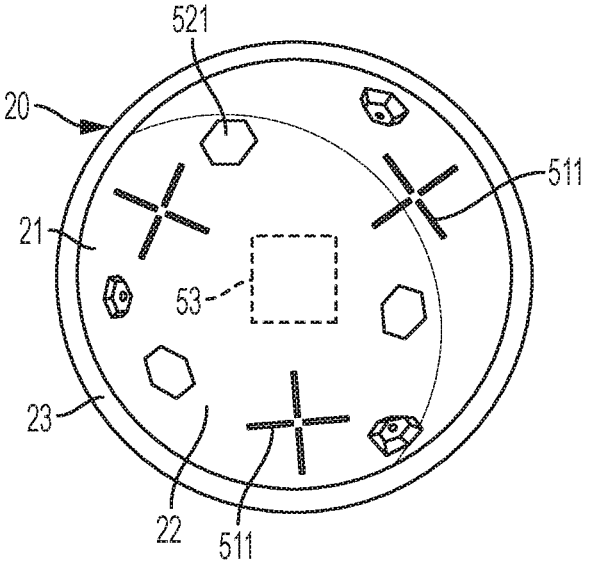
FIG. 6 is a top-down view of a back shell and portions of a retaining system and a piezoelectric ultrasonic linear motor and sensor system in accordance with alternative embodiments.
Figure 7:
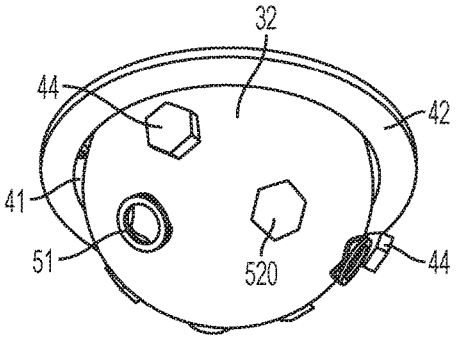
FIG. 7 is a perspective view of a seeker ball and portions of a retaining system and a piezoelectric ultrasonic motor and sensor system in accordance with embodiments.
Figure 12:
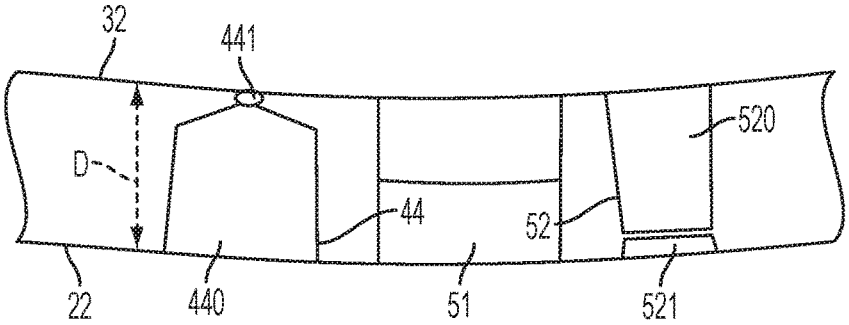
FIG. 12 is a side schematic illustration of the piezoelectric ultrasonic motor and sensor system of FIGS. 5-7.

As shown in FIGS. 5 and 6, the back shell 20 has a partially or semispherical body 21 with a concave surface 22 that terminates at a rim 23. The diameter of the rim 23 is substantially similar to a diameter of the rim 9 of the nose cone 6 and may be coupled to the rim 9 by welding, interference fitting, mechanical fasteners and/or adhesive. As shown in FIGS. 3, 4 and 7, the seeker ball 30 has a body 31 with a convex surface 32 that is disposable to face the concave surface 22 at a distance D (see FIG. 12). The body 31 has a spherical dome shape (a spherical dome is a sphere that is cut by a plane above its equator) that is fittable into the space delimited by the concave surface 22 and is formed to define an interior 33.

Seeker components, such as sensors and other electrical components, are housed within the interior 33 such that EM radiation emitted or received by the BJG seeker assembly 8 via the seeker dome 7 is output or registered by the seeker components. As such, an ability of the BJG seeker assembly 8 to have a full or substantially full range of angular motion especially with respect to the full field-of-regard (FOR) allows a maximized amount of EM radiation to pass through the seeker dome 7 from/to the seeker components. This full or substantially full range of angular motion is facilitated by the retaining system 40 and the piezoelectric ultrasonic motor and sensor system 50, as will be described below, with relatively small and inexpensive parts that may be relatively high-powered.

Figure 8:
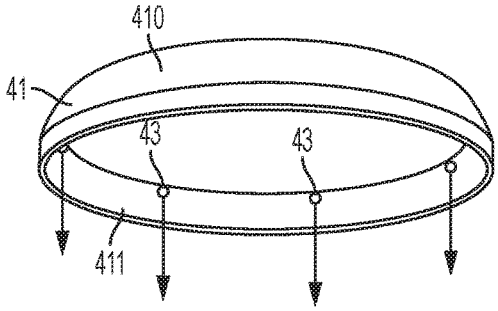
FIG. 8 is a perspective view of a retaining ring and first pins of the retaining system of FIGS. 5-7.
Figure 9:
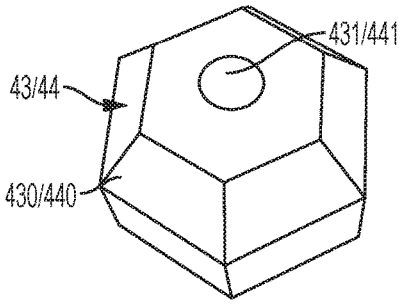
FIG. 9 is a perspective view of a first or second pin of the retaining system of FIGS. 5-7.

Turning now to FIGS. 7-9, the retaining system 40 is disposed to urge the seeker ball 30 toward the back shell 20 and includes a retaining ring 41, an interference ring 42 as well as first pins 43 and second pins 44. The retaining ring 41 includes an annular body 410 that has a lower portion with a first taper and an upper portion with a second taper and a diameter that is less than a diameter of the seeker ball 30. The interference ring 42 includes an annular body 420 (see FIG. 4) that is tightly interposable between an interior surface of the seeker dome 7 (see FIGS. 3 and 4) and an outer surface of the retaining ring 42 to thereby secure the retaining ring 41 in position relative to the seeker ball 30 along a normal direction ND (see FIG. 1) between the first pins 43 and the second pins 44.

The first pins 43 are configured to be provided as a plurality of first pins 43 arrayed about an interior surface 411 of the retaining ring 41 to constrain the seeker ball 30 in the normal direction. The first pins 43 may be arrayed at substantially uniform circumferential distances from one another (e.g., sixty degrees apart in the azimuth in the case of six first pins 43 being provided) and include a base 430, which is affixed to the interior surface 411, and a tip 431. The tip 431 extends from the base 430 to abut with the seeker ball 30 above the hemisphere of the body 31 (where the hemisphere of the body 31 is defined perpendicularly with respect to the normal direction ND). At least the tip 431 of the first pins 43 may be formed of a low friction material, such as Teflon™ or another similar material. Thus, as illustrated in FIG. 8, the first pins 43 press onto the seeker ball 30 along the normal direction ND even as the convex surface 32 of the seeker ball 30 slides along the tips 431 during angular rotations of the seeker ball 30.

The second pins 44 are configured to be provided as a plurality of second pins 44 arrayed or interposed between the concave surface 22 of the back shell 20 and the convex surface 32 of the seeker ball 30 to thereby maintain a separation of the distance D between the back shell 20 and the seeker ball 30. The second pins 44 may be arrayed at substantially uniform circumferential distances from one another (e.g., one hundred and twenty degrees apart in the azimuth in the case of three second pins 44 being provided) and may be disposed at an elevation of about forty five degrees from the hemisphere of the body 31. The second pins 44 may include a base 440, which is affixed to the concave surface 22, and a tip 441. The tip 441 extends from the base 440 to abut with the convex surface 32. At least the tip 441 of the second pins 44 may be formed of a low friction material, such as Teflon™ or another similar material. Thus, the second pins 44 press onto the seeker ball 30 along the normal direction ND in opposition to the first pins 43 even as the convex surface 32 of the seeker ball 30 slides along the tips 441 during angular rotations of the seeker ball 30.

As shown in FIGS. 5-7, 10A and 10B, the piezoelectric ultrasonic motor and sensor system 50 is generally arrayed between the seeker ball 30 and the back shell 20. The piezoelectric ultrasonic motor and sensor system 50 may be pre-loaded by the retaining system 40 and configured to controllably drive an angular orientation of the seeker ball 30 relative to the back shell 20 based on a closed-loop control algorithm. The piezoelectric ultrasonic motor and sensor system 50 includes three or more piezoelectric ultrasonic motors 51, at least one seeker ball angular orientation sensor 52 and, in some embodiments, a closed-loop controller 53, which is disposed in signal communication with each of the three or more piezoelectric ultrasonic motors 51 and the at least one seeker ball angular orientation sensor 52 and a control processor.

Figure 10A:
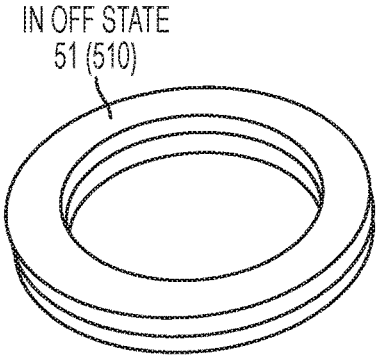
FIG. 10A is a perspective view of a piezoelectric ultrasonic rotary motor in an off state.
Figure 10B:
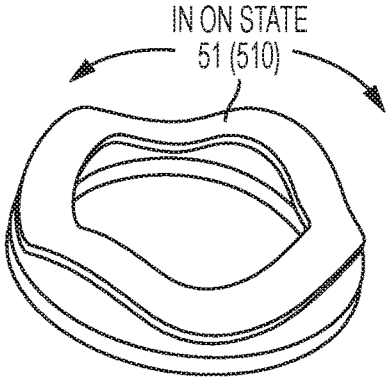
FIG. 10B is a perspective view of a piezoelectric ultrasonic rotary motor in an on state with an arrow indicating a direction of motion imparted by the piezoelectric ultrasonic rotary motor.
Figure 11A:
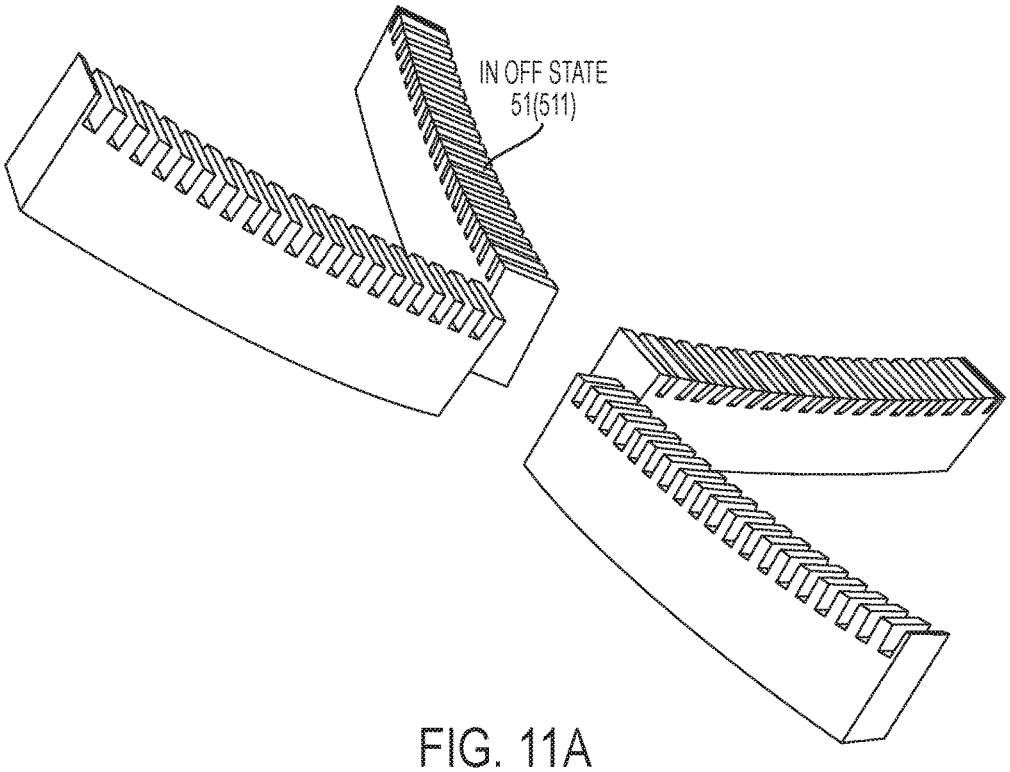
FIG. 11A is a perspective view of a piezoelectric ultrasonic linear motor in an off state.
Figure 11B:
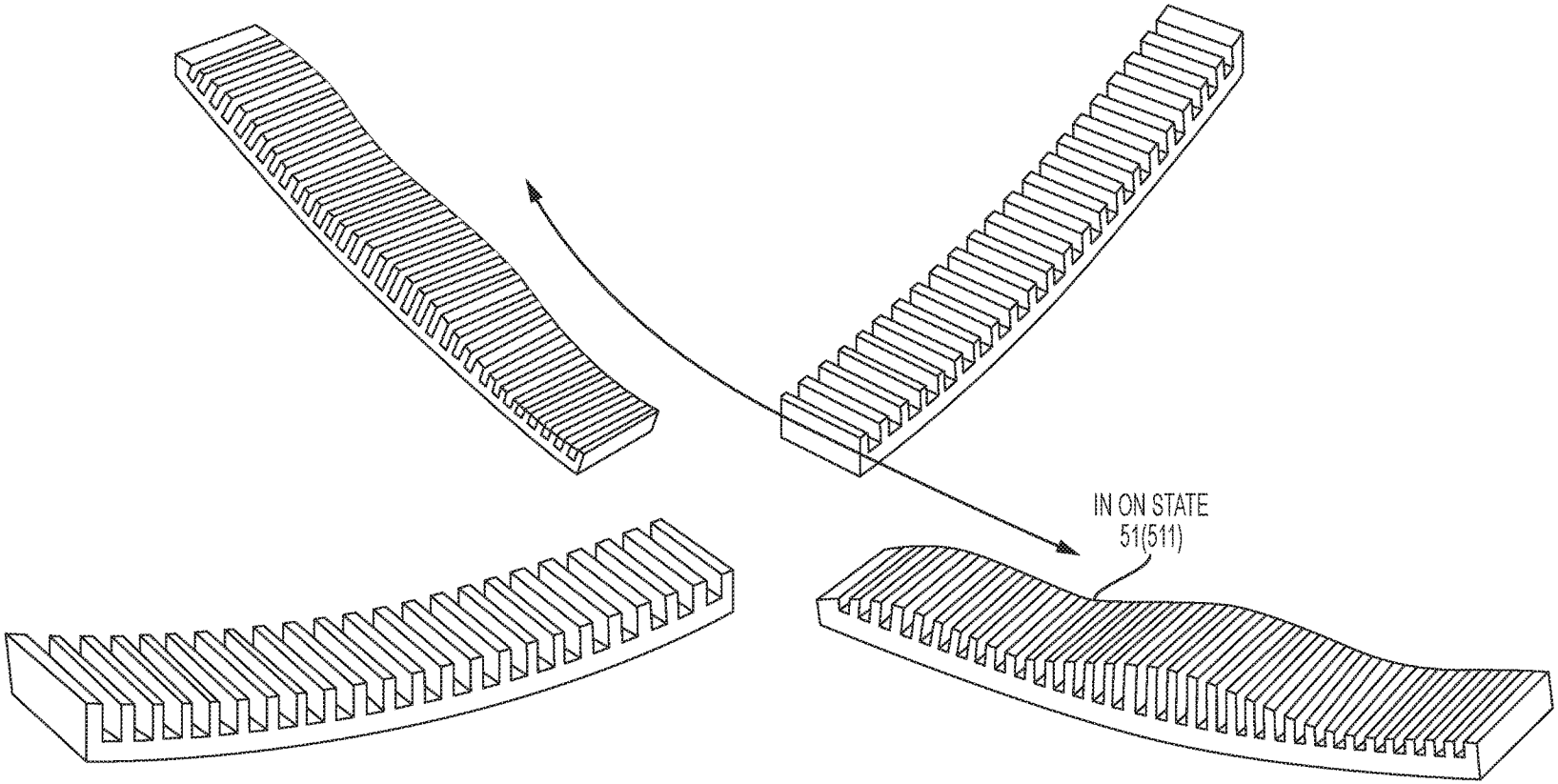
FIG. 11B is a perspective view of a piezoelectric ultrasonic linear motor in an on state with an arrow indicating a direction of motion imparted by the piezoelectric ultrasonic linear motor.

The three or more piezoelectric ultrasonic motors 51 may be substantially uniformly separated from one another (e.g., by one hundred and twenty degrees in azimuth in the case of three piezoelectric ultrasonic motors 51 being provided) and are electric motors that operate as a function of a change in a shape of a piezoelectric material when an electric field is applied as illustrated in the reshaping of the stator of the piezoelectric ultrasonic motor between the off state illustrated in FIGS. 10A and 11A and the on state illustrated in FIGS. 10B and 11B. That is, the three or more piezoelectric ultrasonic motors 51 make use of a converse piezoelectric effect whereby the piezoelectric material produces ultrasonic vibrations in order to produce a rotary motion (see, e.g., FIG. 5 in which the three or more piezoelectric ultrasonic motors 51 are provided as piezoelectric ultrasonic rotary motors 510) or a linear motion (see, e.g., FIG. 6 in which the three or more piezoelectric ultrasonic motors 51 are provided as piezoelectric ultrasonic linear motors 511).

The at least one seeker ball angular orientation sensor 52 may be provided, in accordance with embodiments, as three or more seeker ball angular orientation sensors 52 that are substantially uniformly separated from one another (e.g., by one hundred and twenty degrees in the case of three seeker ball orientation sensors 52 being provided). In any case, the at least one seeker ball angular orientation sensor 52 may include any type of sensor that is capable of detecting rotary or linear motion of the seeker ball 30 relative to the back shell 20. In accordance with embodiments, the at least one seeker ball angular orientation sensor 52 may include a sensor element 520 that is affixed to either the convex surface 32 of the seeker ball 30 or the concave surface 22 of the back shell 20 and a reference element 521 that is affixed to either the concave surface 22 of the back shell 20 or the convex surface 32 of the seeker ball 30 (for purposes of clarity and brevity, the drawings illustrate only the embodiments in which the sensor elements 520 are affixed to the convex surface 32 and the reference elements 521 are affixed to the concave surface 22).

The closed-loop controller 53 may include a processing unit that is receptive of signals from the at least one seeker ball angular orientation sensor 52, a memory and a servo control element that is configured to issue servo control signals to the three or more piezoelectric ultrasonic motors 51. The memory has executable instructions stored thereon, which, when executed, cause the processing unit to receive the signals from the at least one seeker ball angular orientation sensor 52 and thus instruct the servo control element to issue the servo control signals to the three or more piezoelectric ultrasonic motors 51. In this way, the three or more piezoelectric ultrasonic motors 51 can be controlled to angularly orient the seeker ball 30 relative to the back shell 20 according to a predefined target angular orientation.

In accordance with embodiments, the three or more piezoelectric ultrasonic motors 51 can be by the closed-loop controller 53 to provide for line-of-sight stability of the seeker ball 30 relative to the back shell 20. That is, while the missile 1 is in-flight and it's position constantly changes relative to a target, the closed-loop controller 53 can continually reorient the seeker ball 30 relative to the back shell 20 by use of the three or more piezoelectric ultrasonic motors 51. Such continual reorientation allows the seeker ball 30 to maintain its line-of-sight (LOS) stability with respect to the target.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts and equivalents of all means or step plus function elements in the claims below are intended to include any structure, material or act for performing the function in combination with other claimed elements as claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments have been described, it will be understood that those skilled in the art, both now and in the future, may make various improvements and enhancements which fall within the scope of the claims which follow. These claims should be construed to maintain the proper protection for the invention first described.

What is claimed is:

1. A ball joint gimbal (BJG) seeker assembly, comprising:
- a back shell;
- a seeker ball;
- a retaining system disposed to urge the seeker ball toward the back shell; and
- a piezoelectric ultrasonic motor and sensor system arrayed between the seeker ball and the back shell,
- the piezoelectric ultrasonic motor and sensor system being pre-loaded by the retaining system and configured to controllably drive an angular orientation of the seeker ball.

2. The BJG seeker assembly according to claim 1, wherein the seeker ball has a spherical dome shape.

3. The BJG seeker assembly according to claim 1, wherein the retaining system comprises:
- a retaining ring having a diameter that is less than a diameter of the seeker ball;
- first pins configured to be arrayed about an interior surface of the retaining ring to constrain the seeker ball; and
- second pins interposable between the seeker ball and the back shell to maintain a separation between the seeker ball and the back shell.

4. The BJG seeker assembly according to claim 3, wherein the first and second pins are respectively arrayed at uniform distances from one another.

5. The BJG seeker assembly according to claim 3, wherein the first and second pins comprise low friction materials.

6. The BJG seeker assembly according to claim 1, wherein the piezoelectric ultrasonic motor and sensor system comprises three or more piezoelectric motors and at least one seeker ball orientation sensor.

7. The BJG seeker assembly according to claim 6, wherein the piezoelectric ultrasonic motor and sensor system further comprises a closed-loop controller.

8. The BJG seeker assembly according to claim 6, wherein the piezoelectric ultrasonic motor and sensor system comprises piezoelectric ultrasonic rotary or linear motors.

9. A missile, comprising:

a nose cone having an open forward end;

a seeker dome disposable at the open forward end of the nose cone; and a ball joint gimbal (BJG) seeker assembly securably disposable in the open forward end of the nose cone, the BJG seeker assembly comprising:

a back shell configured to be coupled to a rim of the nose cone;

a seeker ball in which seeker components are housed;

a retaining system disposed to urge the seeker ball toward the back shell; and a piezoelectric ultrasonic motor and sensor system arrayed between the seeker ball and the back shell, the piezoelectric ultrasonic motor and sensor system being pre-loaded by the retaining system and configured to controllably drive an angular orientation of the seeker ball.

10. The missile according to claim 9, wherein the seeker ball has a spherical dome shape.

11. The missile according to claim 9, wherein the retaining system comprises:

a retaining ring having a diameter that is less than a diameter of the seeker ball;

an interference ring interposable between the seeker dome and the retaining ring to secure the retaining ring;

first pins configured to be arrayed about an interior surface of the retaining ring to constrain the seeker ball; and second pins interposable between the seeker ball and the back shell to maintain a separation between the seeker ball and the back shell.

12. The missile according to claim 11, wherein the first and second pins are respectively arrayed at uniform distances from one another.

13. The missile according to claim 11, wherein the first and second pins comprise low friction materials.

14. The missile according to claim 9, wherein the piezoelectric ultrasonic motor and sensor system comprises three or more piezoelectric ultrasonic motors and at least one seeker ball orientation sensor.

15. The missile according to claim 14, wherein the piezoelectric ultrasonic motor and sensor system further comprises a closed-loop controller.

16. The missile according to claim 14, wherein the piezoelectric ultrasonic motor and sensor system comprises piezoelectric ultrasonic rotary motors.

17. The missile according to claim 14, wherein the piezoelectric ultrasonic motor and sensor system comprises piezoelectric ultrasonic linear motors.

18. A ball joint gimbal (BJG) seeker assembly for use in a missile including a nose cone having an open forward end and a seeker dome disposable at the open forward end of the nose cone, the BJG seeker assembly comprising:

a back shell configured to be coupled to a rim of the nose cone;

a seeker ball in which seeker components are housed;

a retaining system disposed to urge the seeker ball toward the back shell; and a piezoelectric ultrasonic motor and sensor system arrayed between the seeker ball and the back shell, the piezoelectric ultrasonic motor and sensor system being pre-loaded by the retaining system and configured to drive an angular orientation of the seeker ball relative to the back shell based on a closed-loop control algorithm.

19. The BJG seeker assembly according to claim 18, wherein the piezoelectric ultrasonic motor and sensor system comprises three or more piezoelectric ultrasonic rotary or linear motors, at least one seeker ball orientation sensor and a closed-loop controller.

20. The BJG seeker assembly according to claim 18, wherein the piezoelectric ultrasonic motor and sensor system provides for line-of-sight stability of the seeker ball relative to the back shell.

* * * * *